United States Patent [19]

Kunz et al.

[11] 4,366,365

[45] Dec. 28, 1982

[54] TELESCOPING ELECTRIC HAIR CURLING IRON WITH AN INTEGRALLY MOLDED HAIR CLIP ACTUATOR

[75] Inventors: Raymond W. Kunz, Monroe; Henry J. Walter, Wilton, both of Conn.

[73] Assignee: Clairol Incorporated, New York, N.Y.

[21] Appl. No.: 45,147

[22] Filed: Jun. 4, 1979

[51] Int. Cl.[3] ..... A45D 1/04; H01R 11/00; H01R 39/00

[52] U.S. Cl. ..... 219/225; 16/DIG. 13; 132/31 R; 132/37 A; 219/230; 219/533; 339/8 P; 339/58; 339/101

[58] Field of Search ..... 219/221, 222–230, 219/533; 132/31 R, 31 A, 32 R, 32 A, 33 R, 34 R, 37 R, 37 A; 16/DIG. 13; 339/8 R, 8 P, 34, 35, 58, 101

[56] References Cited

U.S. PATENT DOCUMENTS

| | | | |
|---|---|---|---|
| 996,821 | 7/1911 | Wulff . | |
| 2,056,951 | 10/1936 | Bohall et al. | 219/227 X |
| 2,687,157 | 8/1954 | Cowan | 16/DIG. 13 |
| 3,445,052 | 5/1969 | Lewallem | 16/DIG. 13 |
| 3,950,052 | 4/1976 | Walter et al. | 339/8 R |
| 3,963,291 | 6/1976 | Maloof | 339/8 P |
| 4,003,616 | 1/1977 | Springer | 339/8 R |
| 4,004,596 | 1/1977 | Hyland | 219/225 X |
| 4,032,747 | 6/1977 | Kunz | 219/225 X |
| 4,075,458 | 2/1978 | Moyer | 219/225 |
| 4,097,718 | 6/1978 | Weise | 219/225 X |
| 4,101,757 | 7/1978 | Van Dyck et al. | 219/225 |
| 4,104,507 | 8/1978 | Tisone et al. | 219/222 X |
| 4,104,509 | 8/1978 | Van Bokestal | 219/544 X |

FOREIGN PATENT DOCUMENTS

| | | | |
|---|---|---|---|
| 2246273 | 3/1973 | Fed. Rep. of Germany | 219/225 |
| 1150200 | 8/1957 | France | 219/229 |
| 1375768 | 11/1974 | United Kingdom | 219/225 |
| 2011255 | 7/1979 | United Kingdom | 132/37 A |

*Primary Examiner*—A. Bartis

*Attorney, Agent, or Firm*—Isaac Jarkovsky; John J. Balser; Gerald S. Rosen

[57] ABSTRACT

A telescoping electric hair curling iron includes a molded hollow handle of plastic material having front and rear openings and a longitudinally extending thumb-operated cantilever spring element integrally molded as part of the handle wall. The forward end of the cantilever spring element is downwardly bent to form a depressible thumb button immediately adjacent the front handle opening for operating a spring-biased elongated hair gripping clip pivotally mounted on an electrically heated hair curling rod arranged for slidable telescopic movement through the front opening between a retracted storage position within the handle and an extended operative position outside the handle when the curling rod is in the operative position. The curling rod as heated by a PTC heating element therein. A swivel cord connector is mounted on the inner end of the curling rod and is slidable therewith within the handle and in the retracted position of the curling rod extends out the rear handle opening. Stops in the handle limit movement of the curling rod out of the front handle opening and the swivel connector out of the rear handle opening.

8 Claims, 6 Drawing Figures

TELESCOPING ELECTRIC HAIR CURLING IRON WITH AN INTEGRALLY MOLDED HAIR CLIP ACTUATOR

BACKGROUND OF THE INVENTION

1. Field of the Invention

This invention relates to telescoping electric hair curling irons. More particularly, this invention relates to curling irons having as the curler element a tubular heat conducting member axially slidable into a hollow handle of an electric hair curling iron, a thumb operated cantilever spring integrally molded as part of the handle for lifting the clip that holds the hair against the curler tube which is heated by a heater element in the tube, and a swivelling electrical connector to supply power to the heater element.

2. Description of the Prior Art

Telescoping electric hair curlers with a heat conducting member which retracts into a handle, a thumb operated member associated with the handle, to operate the clip, and an electrical connector are known.

The known telescoping curling irons are intended to be used at home or when traveling. However, these known devices are disadvantageous in certain respects as hereinafter explained. An acceptable curling iron for these uses should be economical to produce and be of a suitable size to be conveniently carried in a pocket, purse or handbag. Thus, if the curling iron, when telescoped, is sufficiently short and has a small enough diameter, it can easily be carried in a pocket or purse or other type of handbag. An additional convenience would be if the curling iron could be retracted into the handle while hot without causing the handle to become hot.

A significant time saver when using electric curling irons is the ability of the curling iron to remain at an acceptable temperature, without the need for reheating during use.

No prior telescoping electric curling iron fulfills all the above criteria. The requirements of such a curling iron are, however, fulfilled by the invention described herein.

Examples of prior electric telescoping curling irons are described by Van Dyck, et al., U.S. Pat. No. 4,101,757 who disclose a telescoping electric curling iron which is unplugged as the plug retracts into the handle when the device is in use, necessitating frequent reheating during use. In addition, the outside diameter of the device is too large for optimum convenience in carrying in a pocket or purse because it has a housing to accommodate the raised end of the clip. The thumb operated member for lifting the clip is a separate part within the handle. The device is made of numerous parts and is thus expensive to produce.

German Pat. No. 2,246,273, published Mar. 8, 1973, discloses a telescoping electric curling iron in which the thumb operated member for lifting the clip is in a housing on the handle, and is not an integral part of the handle. In order to accommodate that mechanism, the diameter of the device is relatively large making it inconvenient to carry in a pocket or purse. In addition, the device is too long for optimum convenience in carrying when the curling iron is retracted because the handle includes room to store the cord.

This invention, unlike prior art devices, provides a compact telescoping electric hair curling iron which is very economical to produce since the thumb operated clip control is an integral part of the handle, is of a sufficiently small size to be easily stored for traveling because the handle does not need to have storage room for the cord and there is no need to include a housing in the handle for the clip end or the thumb operated clip control member, is easy to use as there is no need to frequently reheat the tubular curler member because the curling iron operates while plugged in and the temperature of the heated tubular curler member can be controlled by conventional commercially available heating elements such as resistance heaters with a temperature indicator, positive temperature coefficient (PTC) heaters and the like. A PTC heater is preferred since it can control the temperature without the need for a thermostat or temperature indicator. In addition, the tubular curler member can be retracted into the handle while hot without causing the handle to become hot.

No prior art discloses a telescoping electric hair curler that utilizes a swivel connector, such as disclosed in Walter, et al., U.S. Pat. No. 3,950,052, capable of sliding in the handle as the curling tube is extended and retracted.

SUMMARY OF THE INVENTION

There is provided by the invention a telescoping electric hair curling iron which comprises a hollow handle having as an integral part thereof a cantilever spring element which when depressed opens the hair clip. The hair clip is hingedly affixed to a heat conducting curler tube so that hair can be engaged between the clip and the tube. The clip is opened by depressing the cantilever spring element and closes when the spring element is released. A spring attached to the clip at its hinge axis keeps the clip under tension against the hair on the curler tube. The temperature of the curler tube is controlled by a heating element preferably a PTC heater, attached to the inside of the tube. The curler tube is axially slidable into the handle of the curling iron.

Electricity is supplied through a plug in a swivel housing connected by contacts to the heating element. The swivel plug mechanism slides into the handle when the curler tube is extended and returns to the end of the handle when the curler tube is retracted. The device is operated while plugged into an electrical outlet.

It is an object of this invention to provide a telescoping electric hair curling iron which is economical to produce, convenient to use, and which can be easily carried in a pocket, purse, handbag, or the like.

DETAILED DESCRIPTION OF THE INVENTION

The telescoping electric hair curling iron of this invention has a structure which enables it to be manufactured with relatively few parts and in a compact size.

Figure 1:
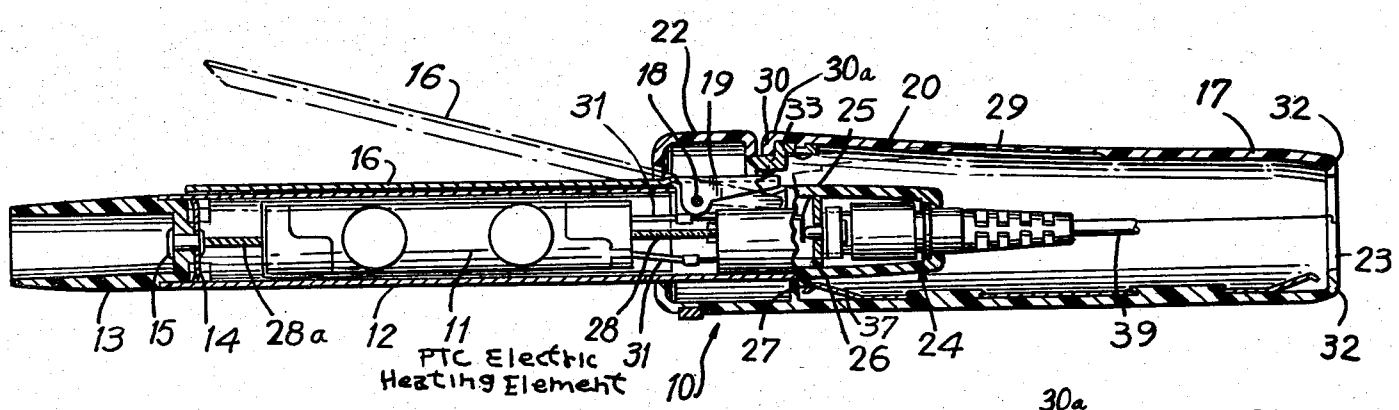
FIG. 1 is a longitudinal view, in section, of the preferred embodiment of the telescoping electric hair curling iron with the tubular curling element extended out of the handle ready for use.
Figure 1A:
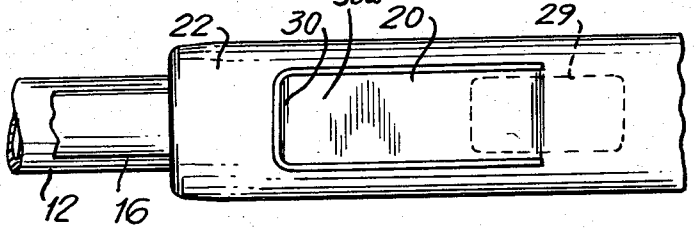
FIG. 1A is a partial top plan view showing the integral relationship of the cantilever spring and hinge to the rest of the handle.

As shown in FIG. 1, the curling iron 10 with a PTC heating element 11 disposed in a tubular heat conducting member 12 (the curling rod) is slidably connected to a hollow handle 17, which handle is shorter than the prior devices since the swivel cord connector 24 which is connected to the curling rod 12 through contacts 25 and 26, slides forward into the hollow handle 17 when the curling rod 12 is extended and slides backward out of the hole 23 in the hollow handle 17 when the curling rod 12 is retracted. Therefore, the handle need not have storage space for the cord as is required, for example, in the device disclosed in German Pat. No. 2,246,273.

The diameter of the hollow handle 17 is smaller than the known devices since the cantilever spring element 20 is an integral part of the handle 17 and needs no extra housing to protect it. In addition, the clip projection 19 is not angled upward, thus not requiring a larger handle to enable the curling rod to retract. This clip projection 19 structure is possible because the cantilever spring element 20 is integral with the handle 17 and is bent at its forward end 30 forming an integrally molded thumb button 30*a* to enable it to contact the clip projection 19 without increasing the angle of the projection 19 from the horizontal. The tubular member 12 has an insulating member 13 attached to the end thereof. The insulating member 13 is attached to the tubular heat conducting member 12 by spring clip 14 and rivet 15. A conformably shaped hair clip 16 shown open (dotted lines) and closed (solid lines) fits hingedly over the tubular member 12 and slides axially with the tubular member into the handle 17 which is made of a heat insulating material. The hair clip 16 is hingedly attached to the front end of the swivel cord connector housing 24A with a pivot pin 18. The end of the clip 16 over the pivot pin 18 forms a projection 19. This projection 19 is in operative relationship to cantilever spring element 20 which is an integral part of the handle 12, when the tubular member 12 is extended. The cantilever spring element 20 pivots on hinge 29 which is a narrowed portion of the hollow handle 17 casing.

Figure 3:
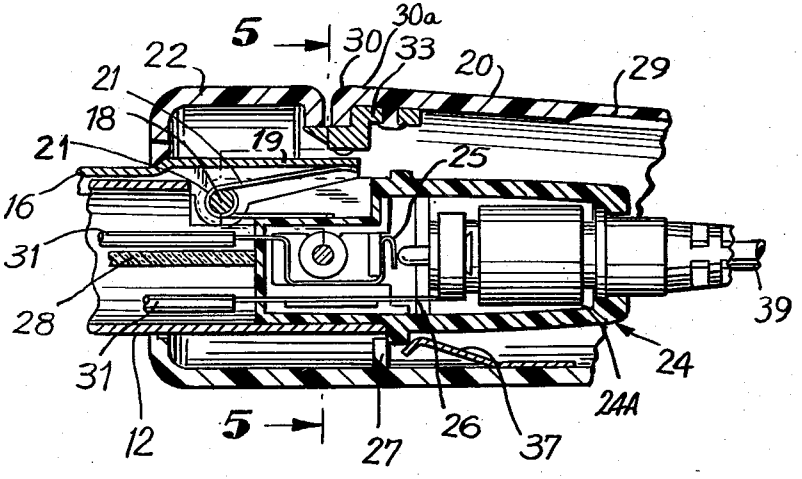
FIG. 3 is an enlarged view, in cross section, of the thumb operated cantilever spring member when the tubular curling element is extended out of the handle ready for use.
Figure 4:
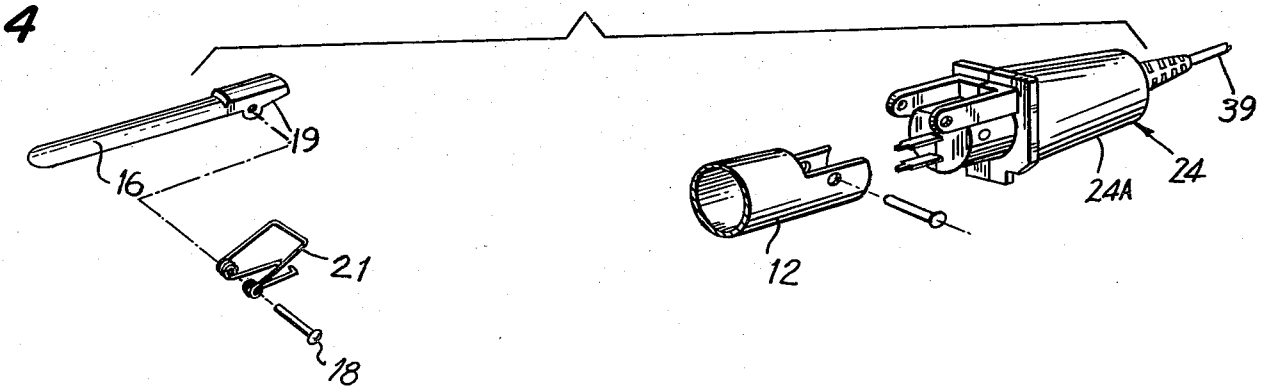
FIG. 4 is an exploded view of the clip, spring, swivel plug and contact.

As can be seen in FIGS. 3 and 4, the clip projection 19 on the pivot pin 18 is under spring pressure by the spring 21 which is wound around the pivot pin 18. When the cantilever spring element 20 is depressed, e.g., at the thumb button 30*a* with the thumb, with sufficient force to overcome the tension of spring 21, the clip projection 19 is depressed and the clip 16 is opened. Hair can then be wound around the tubular member. Release of the cantilever spring element 20 releases the clip 16 which returns to its closed position and holds the hair against the tubular member 12.

The handle 17 extends forward beyond the cantilever spring element 20 to form a guard 22 for the spring element 20. The plastic stop 33 which is attached to the cantilever spring element 20 at the thumb button 30*a*, e.g., at the juncture of the front bent portion 30, prevents the spring element 20 from bending when not depressed with, e.g., the thumb.

When the curling iron 10 is extended by grasping the insulated tip 13 and pulling it to extend the curling rod 12 out of the hollow handle 17 a swivel cord connector 24 which is connected to the PTC heating element 11 in the curling rod 12 through contacts 25 and 26 moves with the curling rod 12 and enters the handle 17 through the opening 23 taking the electric cord 39 with it. The electric cord 39 only moves the same distance the swivel cord connector 24 moves so there is no danger of pulling the cord out of the electric socket. In order to prevent the tubular member 12 and swivel cord connector 24 from sliding out of the front of the handle 17, stops 27 are provided. In addition, a mica spacer 28 prevents the tubular member 12 from contacting the swivel cord connector 24 by folding the wires 31 and a microspacer 28*a* prevents the heater from moving forward to strike the insulated tip 13. Wires 31 carry power between the swivel cord contacts 25 and 26 to the heating element 11. The detent springs 37 provide a latching effect on the curling rod in both fully extended and fully retracted positions.

Figure 2:
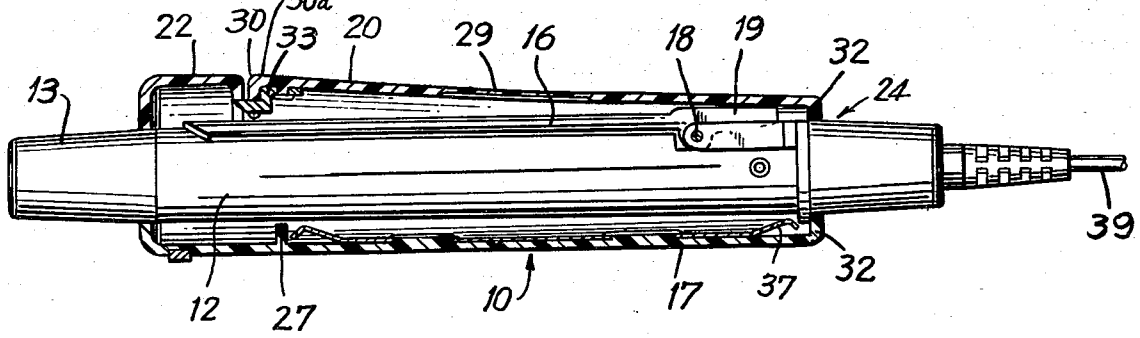
FIG. 2 is a longitudinal view, partially in section, of the preferred embodiment of the telescoping electric hair curling iron with the tubular curling element retracted into the handle.
Figure 5:
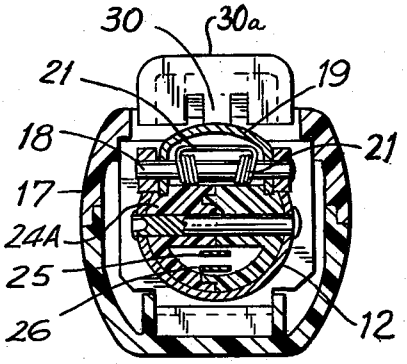
FIG. 5 is a sectional transverse view of the handle taken along line 5—5 of FIG. 3.

FIG. 2 shows the telescoping electric hair curling iron 10 in retracted position. When retracted, the swivel cord connector 24 is in the opening 23 outside the handle 17. The opening 23 is provided with stops 32 which prevent the swivel cord mechanism 24 from falling out of the handle 17. The tubular heat conducting member 12 and the clip 16 are inside the handle 17. Only the insulating member 13 on the end of the tubular member 12 extends out of the handle 17 when the hair curling iron 10 is in the retracted position. The cantilever spring member 20 cannot operate when the tubular member 12 is retracted since it rests against the clip 16 which is in an unyielding position. The diameter of the handle 17 at the point where the cantilever spring member 20 is located is not significantly larger than the diameter of the rest of the handle 17.

The telescoping electric hair curler 10 is advantageous because it has a short handle with a comparatively small diameter so that when the tubular curler element is retracted into the handle, the unit can easily be stored in a pocket, purse or handbag. In use, the device remains plugged in, maintains its temperature because of the PTC heating element, and thus does not need to be reheated.

In order to use the telescoping electric hair curling iron 10 of this invention, the tubular heat conducting member 12 is extended from the handle 17 by pulling the insulated tip 13 until the swivel cord mechanism 24 is stopped by stopper 27. At this point the raised projection 19 on the clip 16 is in operative engagement with the front bent portion 30 at the thumb button 30*a* of the cantilever spring 20 which is depressed to raise the clip 16 from the tubular member 12. The hair is then wound around the tubular member 12 and the cantilever spring 20 is released causing the clip 16 to return because of the tension in springs 21 to the closed position and hold the hair in place. The cord 39 is then plugged into an electric socket. The electricity causes the PTC heating element 11 to become hot and heat the tubular member 12 to a temperature which will cause the hair to plasticize and conform to the shape of the tubular member 12, but will not burn the hair or scalp.

The PTC heater 11 maintains the temperature at the desired level.

When the operation is completed, the plug, not shown, is removed from the electric socket, not shown, the hair curling iron 10 is removed from the hair, and the tubular heat conducting member 12 is retracted into the handle 17 by pushing on the heat insulated end 13 made of low thermal conductivity plastic. This can be done while the unit is hot since the handle 17 is insulated as it is made of low thermal conductivity plastic.

The hair curling iron 10 then can be stored or packed by the user.

We claim:

1. A telescoping electric hair curling iron comprising:

(a) a molded hollow handle of plastic material having a front opening;

(b) a longitudinally extending cantilever spring element integrally molded as part of the wall of said handle from the same plastic material thereof;

(c) a depressible thumb button immediately adjacent the front opening of said handle and integrally molded as part of said cantilever spring element from the same plastic material wherein said depressible thumb button is formed by a downwardly bent forward end of said cantilever spring element;

(d) an elongated heat conducting means arranged in said handle for telescopic axial movement through said front opening therein between a first position projecting from the front of said handle and a second position substantially enclosed within said handle;

(e) an electric heat generating element for heating said heat conducting means and fixed within said heat conducting means so as to be telescopically movable therewith relative to said handle;

(f) an elongated hair gripping means coextensive with and mounted on said heat conducting means for movement toward and away from the surface thereof and axially movable therewith to said first and second positions, a portion of said hair gripping means parallel with the longitudinal axis of said heat conducting means and extending beyond the end thereof cooperating with said thumb button when said heat conducting means is in said first position whereby depression of said thumb button causes said hair gripping means to move toward and away from said conducting means to permit gripping and releasing of hair to be curled;

(g) an electric swivel cord connector means mounted on the inner end of the heat conducting means within the handle so as to be moveable with said heat generating element by sliding forward into said handle when said heat conducting means is moved to said first position and sliding backwards out of a rear opening in said handle when said heat conducting means is moved to said second position, said swivel cord connector means being adapted to connect to an external electrical source for conveying electricity to said heat generating element.

2. A telescoping electric hair curling iron according to claim 1 wherein said heat conducting means is tubular and said heat generating means is disposed within said tubular heat conducting means.

3. A telescoping electric hair curling iron according to claim 2 wherein said heat generating means is a positive temperature coefficient electric resistance heater.

4. A telescoping electric hair curling iron according to claim 1 wherein the inside of the handle contains a stop to prevent the heat conducting means from completely sliding out of the front of the handle and separating therefrom.

5. A telescoping electric hair curling iron according to claim 1 wherein said hair gripping means is pivotally attached to the swivel cord connector housing and longitudinally extends along said heat conducting means, said hair gripping means having a raised portion on the end toward the handle which is in operative relationship to the thumb button.

6. A telescoping electric hair curling iron according to claim 5 wherein said hair gripping means is pivotally attached to the swivel cord connector housing at the end thereof toward the front of the handle by a pin which is substantially perpendicular to the axis of the curling iron.

7. A telescoping electric hair curling iron according to claim 1 wherein said electric swivel cored connector means connects said heat generating element to an external source of power by means of contacts.

8. A telescoping electric hair curling iron according to claim 1 wherein the handle contains stops to prevent said electric swivel cord connector means from sliding out of the back of the handle and separating therefrom.

* * * * *